US005560658A

United States Patent [19]

Coolman et al.

[11] Patent Number: 5,560,658

[45] Date of Patent: Oct. 1, 1996

[54] CONSTRUCTION OF AND LATCHING ARRANGEMENT FOR LARGE-SIZE OVERHEAD BI-FOLD DOORS

[75] Inventors: David W. Coolman, Plymouth; Eugene Sawyer, Shawano, both of Wis.

[73] Assignee: Plyco Corporation, Elkhart Lake, Wis.

[21] Appl. No.: 421,363

[22] Filed: Apr. 13, 1995

[51] Int. Cl.$^6$ ..... E05C 19/10

[52] U.S. Cl. ..... 292/28; 292/125; 292/201; 292/DIG. 36; 160/209; 160/213

[58] Field of Search ..... 292/194, DIG. 36, 292/28, 50, 110, 201, 125, 122, 225; 160/209, 213

[56] References Cited

U.S. PATENT DOCUMENTS

| | | | |
|---|---|---|---|
| 1,135,768 | 4/1915 | Clay | 292/50 |
| 1,720,554 | 7/1929 | Johnson | 292/125 X |
| 2,703,247 | 3/1955 | Wolf et al. | 292/DIG. 36 X |
| 3,177,022 | 4/1965 | McKee et al. | 292/50 |
| 3,258,062 | 6/1966 | Lambert | 292/DIG. 36 |
| 5,168,914 | 12/1992 | Keller | 292/201 X |

*Primary Examiner*—Rodney M. Lindsey
*Attorney, Agent, or Firm*—Francis J. Bouda

[57] ABSTRACT

The large overhead bi-fold doors of the present invention are hinged along a centerline and hung by hinges from the top of the door opening. A motor mounted inside and above the door opening is connected to one end of a cable, the other end of which passes around a pulley at the bottom of the door and then upwardly to a latching mechanism located beneath the horizontal hinge line of the doors. When the motor is activated, the cable pulls on a dog or arm connected to a shaft which also carries the hook of a latching device. The hook engages a strike attached to the frame of the building on which the door is mounted, and when the motor is activated, the cable pulls on the dog which disengages the hook from the strike and further tension on the cable by the motor raises the door to an elevated position. When the door is lowered and is approaching closed position, the cable is slackened, allowing a torsion spring connected to the shaft to rotate the latch into engaging connection with the strike and to draw the door tightly against the sides of the opening in the building.

4 Claims, 3 Drawing Sheets

Fig. 3
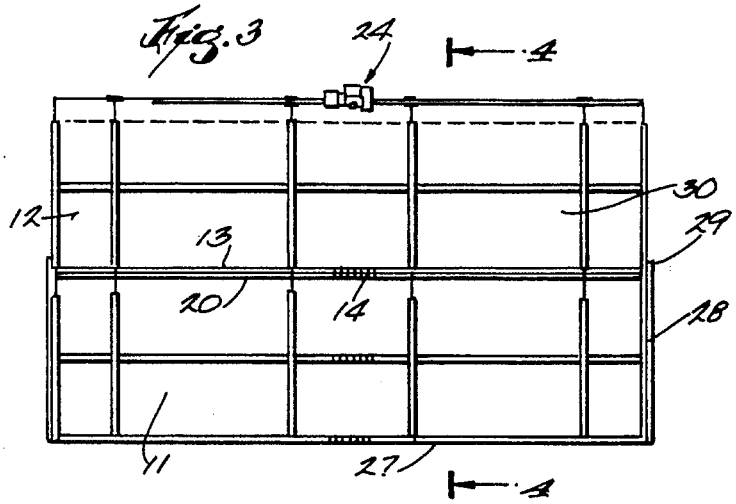
Fig. 4
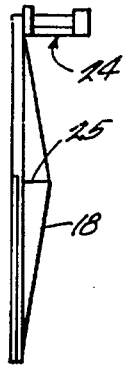
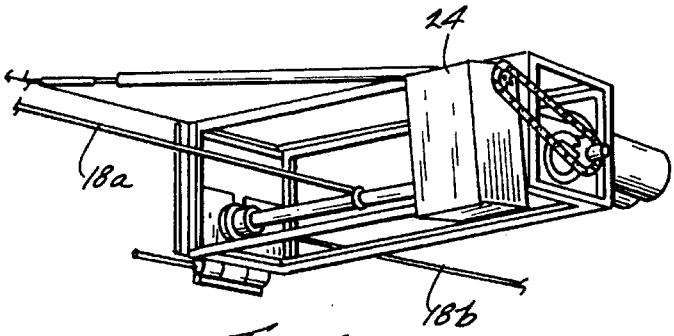
Fig. 5
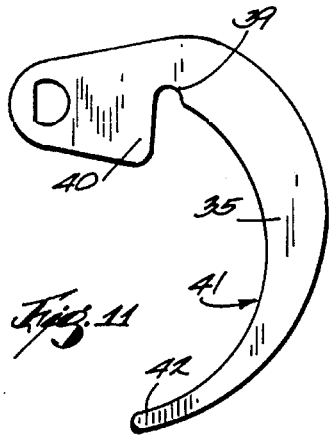
Fig. 11
Fig. 12.
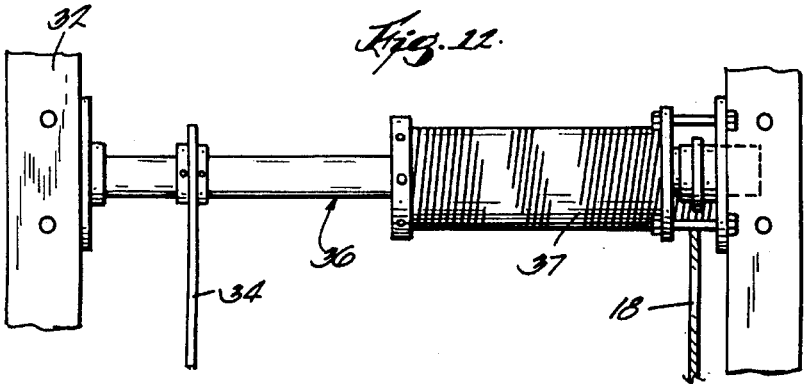

CONSTRUCTION OF AND LATCHING ARRANGEMENT FOR LARGE-SIZE OVERHEAD BI-FOLD DOORS

BACKGROUND OF THE INVENTION

Bi-fold doors for large openings are not new and are seen frequently in buildings such as aircraft hangers, automotive shops, farm barns and the like. Prior art construction of such bi-fold overhead doors are shown in:

| | | |
|---|---|---|
| Egleston | 3,024,838 | 03/13/1962 |
| Alton | 3,504,729 | 04/07/1970 |
| Pollock | 4,088,172 | 05/09/1978 |
| DeVore | 4,243,091 | 01/06/1981 |
| Geisthardt | 4,509,291 | 04/09/1985 |
| List | 4,545,418 | 10/08/1985 |
| Keller | 4,609,027 | 09/02/1986 |
| Johnson | 4,903,747 | 02/27/1990 |
| Keller | 5,168,914 | 12/08/1992 |

SUMMARY OF THE INVENTION

The prior disclosures and inventions were directed to the means for opening and supporting huge bi-fold doors in an overhead position, and because of the size of such structures, the means for holding the doors in an elevated position often required brackets and braces which reduced the clear opening beneath the door in its elevated position.

Moreover, many of these constructions did not provide a latching and locking arrangement which would secure the door when in a lowered and closed position in the face of exceedingly strong winds or against intruders.

The door of the present invention can provide up to 10 to 16 more inches of clear door opening than is possible with doors of prior construction. Even more importantly, the doors of the present invention provide a needed and necessary clearance without increasing the building height.

Additionally, it is simple and easy to be installed by the owner of the building, its operation is not affected by snow or ice, and it provides a positive seal along all sides and the hinge line.

The doors roll on heavy jamb rails attached to the exterior of the building column, and the unique jamb latches secure the door sides. It operates automatically when the door is closed and unhooks automatically when instructions are given to the door to open.

Thus it is an object of the present invention to provide a large overhead bi-fold door which is positive in operation and secure when closed, providing more overhead clearance space beneath the door with an automatic, positive locking device.

Another object is to provide a jamb-latch which holds the door tightly against the building to seal the opening against inclement weather and against intruders.

Another object is to provide a door which can be mounted above the opening in the wall and on the outside of the building and can be secured on the inside.

Another object is to provide a door which is motor-operated and wherein the motor can be installed inside the building out of the inclement weather dust and dirt and which remains accessible even when the door is fully raised.

With the above and other objects in view, further information and a better understanding of the present invention may be achieved by referring to the following detailed description:

DETAILED DESCRIPTION

For the purpose of illustrating the invention, there is shown in the accompanying drawings a form thereof which is at present preferred, although it is to be understood that the various instrumentalities of which the invention consists can be variously arranged and organized, and that the invention is not limited to the precise arrangement and organizations of the instrumentalities as herein shown and described.

In the drawings, wherein like reference characters indicate like parts:

FIG. 3 is a front skeletal view of the door of the present invention.

FIG. 4 is a side view taken generally along line 4—4 of FIG. 3.

FIG. 5 is a perspective view of the drive mechanism of the door of the present invention.

FIG. 11 is a side view of the latch.

FIG. 12 is a front view of the auto latch torsion spring assembly.

Figure 1:
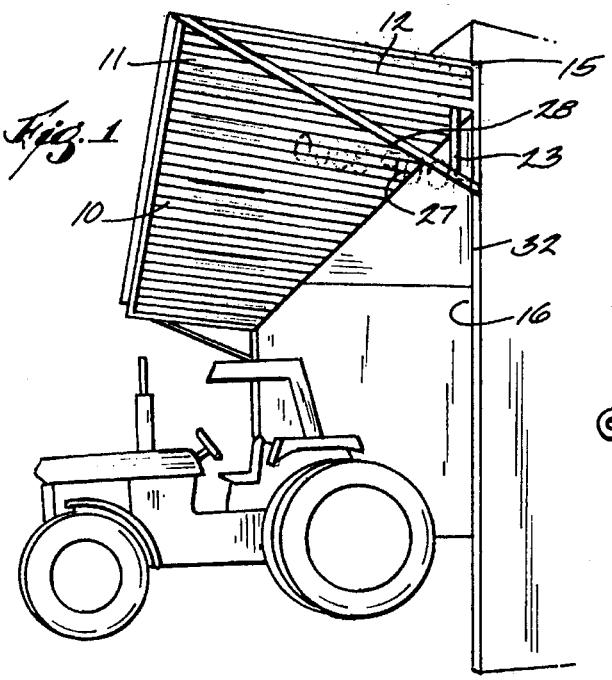
FIG. 1 is a perspective view of the bi-fold door of the present invention shown in the open position.
Figure 13:
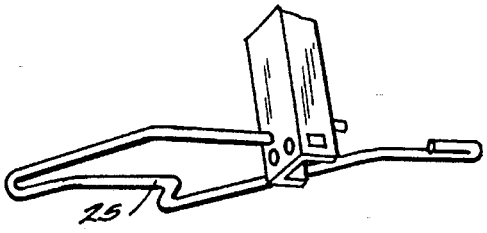
FIG. 13 is a perspective view of the cable popper.

Referring now to FIG. 1 it can be seen that the bi-fold door 10 of the present invention is a 2-piece member consisting of a large lower panel 11 and a large upper panel 12. These panels can also be clearly seen in FIGS. 2, 3 and 9. These panels or frames are made of channel irons, and if each of the panels 11 and 12 is a single unit, they may fit doors as wide as 16 ft. If the doors are wider than 16 ft., each of the panels 11 and 12 may be made up of a plurality of smaller units.

The panels 11 and 12 are joined along a centerline 13 by a plurality of hinges 14, and are supported or hung from the horizontal upper edge 15 of the door opening 16 by other hinges 17. A cable 18 is fastened at one end 19 near the upper edge 20 of the lower panel 11. The cable 18 passes over a series of pulleys 21, 22 and 23 to be connected to the motor or power-drive system 24 hereinafter to be described.

Midway between the pulleys 21 and 22, the cable 18 is pushed outwardly away from the hinge line 13 by a cable popper 25, as is clearly shown in FIGS. 4, 8, 9 and 14. Also between fastening end 19 and pulley 21, the cable 18 rides over a roller 26.

When the motor 23 is operated, it pulls on the cable 18 and draws the bottom 27 of the panel 11 upwardly, forcing the hinge line 13 to be pushed outwardly by the cable popper 25 away from the building, and thus to raise the panels to the position shown in FIG. 1.

As the panels 11 and 12 are lifted, an arm 28, which is pivoted at 29 to the lower portion 30 of the upper panel 12, swings downwardly and outwardly so that a roller 31 is caused to rest against the door jamb 32 as shown in FIG. 1.

A chain 33 limits the distance to which the roller 31 may fall downwardly below the pivot 29, and thus the arm 28 creates a triangular brace to rigidly hold the hinge line 13 and the mating portions of the panels 11 and 12 in the outward and elevated position as shown in FIG. 1.

Figure 2:
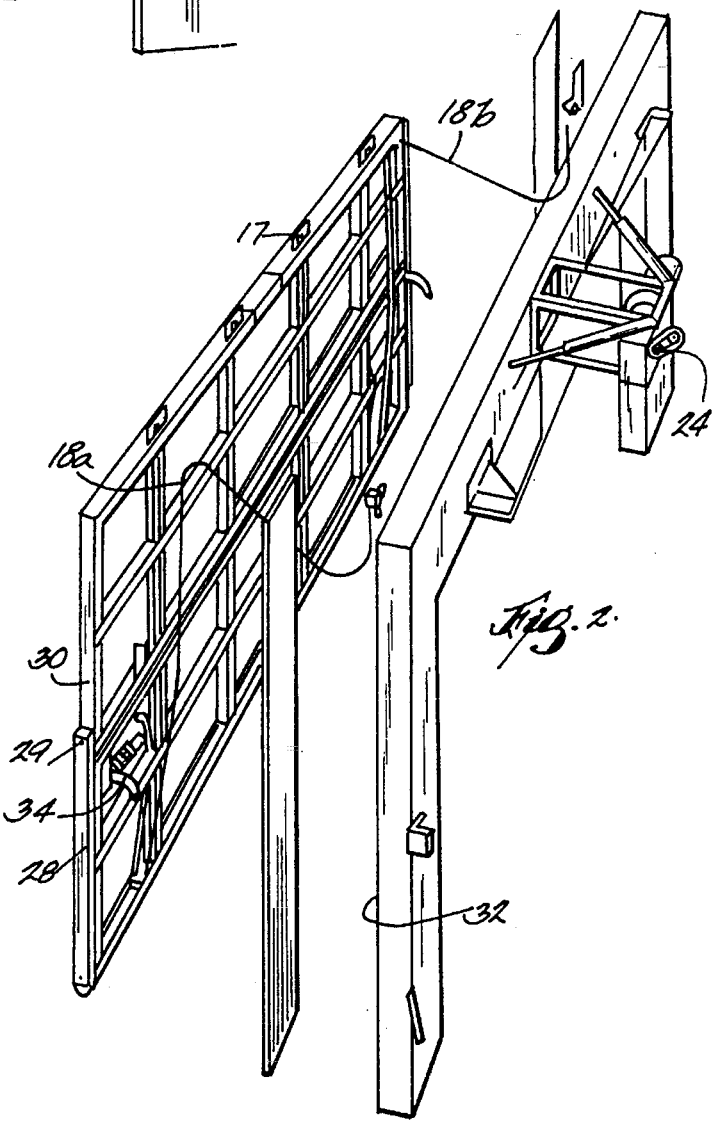
FIG. 2 is an exploded perspective internal view of the bi-fold door of the present invention.

As is shown in FIG. 2, the door 10 can have a dual lifting arrangement so that one cable 18*a* operates at one side of the door and another cable 18*b* operates at the other side of the door. Both of the cables 18*a* and 18*b* are operated by a single drive motor 24. If desirable, for smaller doors, a single cable and lift arrangement may be satisfactory.

A principal feature of the present invention is the latching arrangement 34 shown in FIGS. 6, 7, 10, 11 and 12. This latch arrangement includes a hook 35 on a shaft 36 which pivots so that the hook is driven by a torsion spring 37 into engagement with a latch strike 38.

Figure 8:
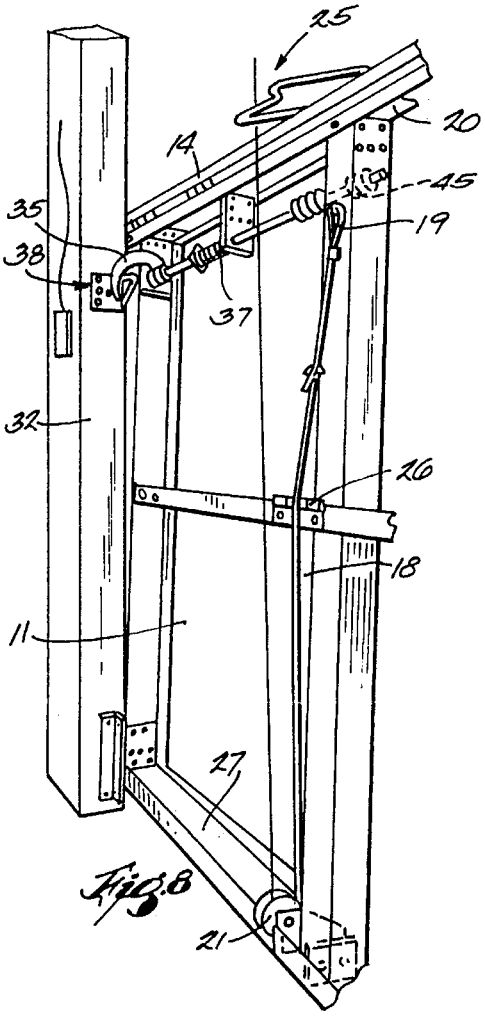
FIG. 8 is a perspective view of the lower portion of a closed door showing particularly the hook and latch strike arrangement.
Figure 7:
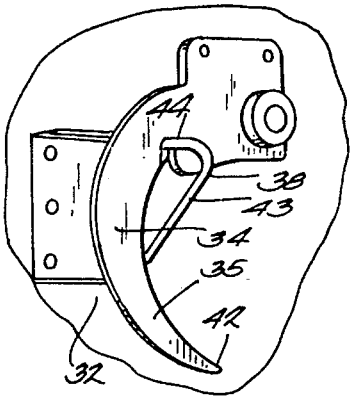
FIG. 7 is a perspective view of the latch with the hook engaging the latch strike.
Figure 6:
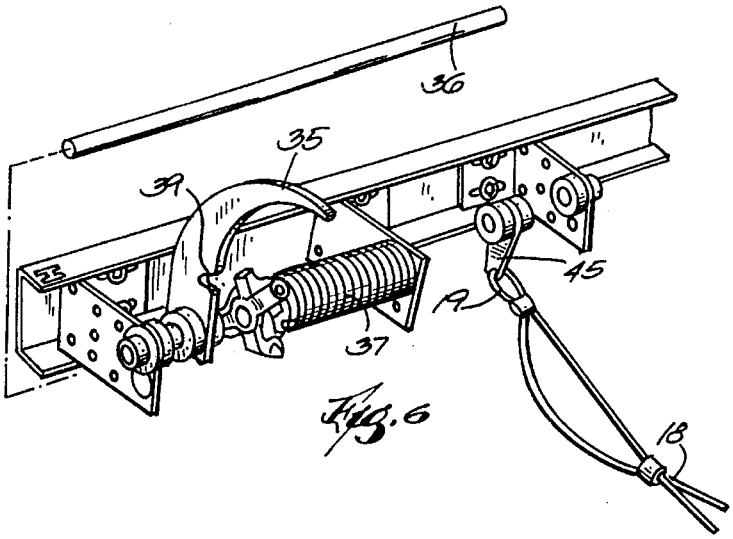
FIG. 6 is a perspective view, from the inside looking out, of the latch system of the present invention.

The latch strike is mounted on the jamb 32 of the building, as is shown in FIGS. 7 and 8.

The latch hook 35 is shown particularly in FIGS. 6, 7, 10 and 11, and it includes a locking notch 39 and a lip or stop 40 appropriately spaced with respect to the axis of the shaft 36.

In addition, the hook 35 has a curved portion 41 and a tip portion 42 designed so that the portion 41 extends around the lower portion 43 of the strike 38 when the notch 39 engages the upper portion 44 of the strike 38.

A torsion spring 37 drives the hook 35 into engagement with the strike 38 when the door 10 is lowered to the closing position shown in FIG. 8.

Figure 10:
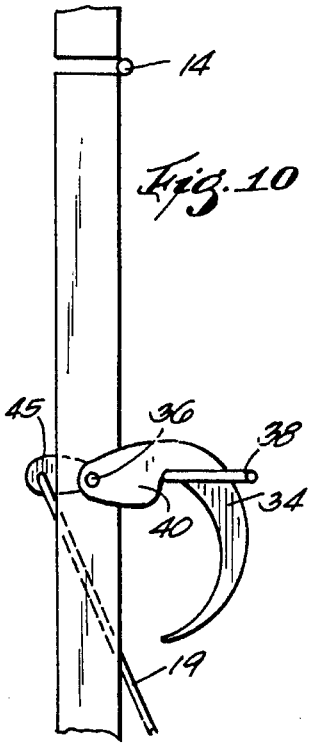
FIG. 10 is a side view of the latch and strike position in a locked condition.

At this time the torsion spring 37 forces the tip 42 of the hook 35 around the strike 38, drawing the hinge-line 13 of panels 11 and 12 tightly against the door jamb 32 as shown in FIG. 10.

Also attached to the shaft 36 is a cable dog 45 which has the upper end 19 of the lift cable 18 fastened thereto.

When the end of the cable 18 which is attached to the motor drive 24 is brought into tension by the motor, the portion of the cable 18 attached to the cable dog 45 rotates the shaft 36 and causes the latch hook 35 to be disengaged from the latch strike 38. A continued pulling on the cable 18 by the motor 24 causes the cable popper to push the center of the door outwardly and at the same time lift the lower end 27 of the panel 11 upwardly so that the bi-fold door swings outwardly to the position shown in FIG. 1 with the arm 28 supporting the doors in the open position.

Figure 9:
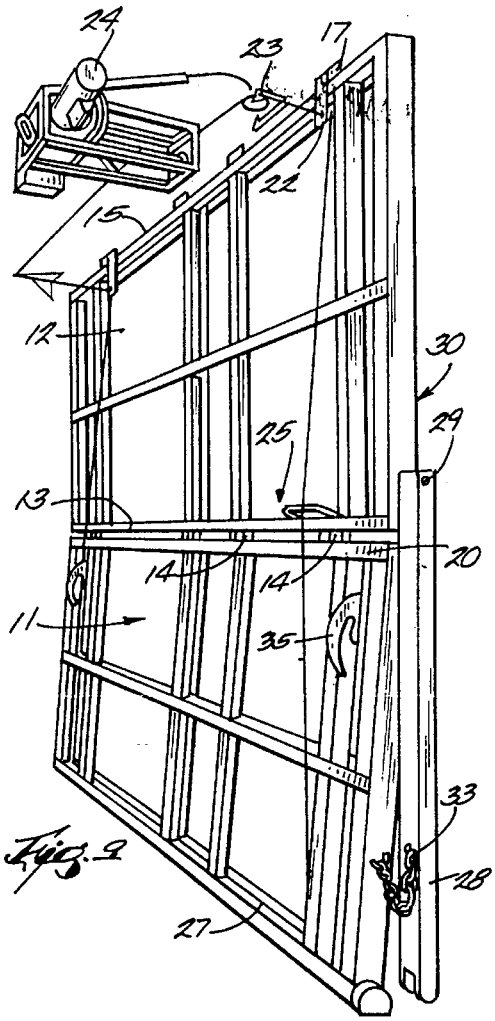
FIG. 9 shows the door in a position just shortly after the door begins to open.

When the direction of the motor is reversed (under instructions to lower the door), the motor 24 releases the tension on the cable 18 permitting the bottom edge 27 of the lower panel 11 to move downwardly along the jamb 32 of the building to the position generally shown in FIGS. 8 and 9. After panel 11 is lowered, continued motor operation allows slack to occur in the lift cable, and torsion spring 37 causes latch 35 to rotate into engagement with the latch strike 38, drawing the centerline 13 of the panels 11 and 12 into tight engagement with the door jamb.

Thus is described a door construction which is secure, rigid, positive in its operation, strong in construction against winds, both in the open position and in the closed position, but which, more importantly, provides a simultaneous, tight-locking mechanism for the door against the jamb and also against accidental opening or deliberate opening by intruders.

It is furthermore to be understood that the present invention may be embodied in other specific forms without departing from the spirit or special attributes; and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to protect by Letters Patent are the following:

1. A 2-panel, bi-fold door with an upper panel and a lower panel and a horizontal hinge-line between the panels for closing an opening in a building having a framework around the opening, including a motor, a cable having a first end attached to the motor, a shaft supported on the lower panel, a dog affixed to the shaft, a second end of the cable attached to the dog, a latch attached to the shaft and a latch-strike attached to the framework, a spring on the shaft for rotating the latch into engagement with the strike, said latch being dis-engaged from the strike when the motor causes the cable to pull on the dog and rotate the shaft.

2. The bi-fold door of claim 1 wherein said shaft is located on the lower panel near the hinge line so that the latch draws the hinge line of the panels against the framework when the two panels are in a lowered position.

3. The bi-fold door of claim 2 including a pulley at the bottom edge of the lower panel around which the cable passes between the dog on said shaft and said motor and a cable popper affixed to one of said panels adjacent the hinge line.

4. The bi-fold door of claim 1 wherein said latch has a crescent shape so that the latch can curve around the strike when said spring causes the shaft to rotate.

* * * * *